US007527109B2

(12) United States Patent
Barker et al.

(10) Patent No.: US 7,527,109 B2
(45) Date of Patent: May 5, 2009

(54) LOCATING APPARATUS AND SYSTEM

(75) Inventors: Steven H. Barker, Sweeney, TX (US); William Patrick Doyle, West Columbia, TX (US); Charles D. Wachtstetter, Richwood, TX (US)

(73) Assignee: Doyle & Wachstetter, Inc., Clute, TX (US)

( * ) Notice: Subject to any disclaimer, the term of this patent is extended or adjusted under 35 U.S.C. 154(b) by 384 days.

(21) Appl. No.: 11/262,900

(22) Filed: Oct. 31, 2005

(65) Prior Publication Data

US 2006/0090578 A1 May 4, 2006

Related U.S. Application Data

(60) Provisional application No. 60/624,002, filed on Nov. 1, 2004.

(51) Int. Cl.
*E21B 49/00* (2006.01)
*G01V 9/00* (2006.01)

(52) U.S. Cl. ..... 175/21; 73/864.74; 73/37; 73/866.5; 116/205; 116/209; 175/50

(58) Field of Classification Search ..... 175/21, 175/50; 73/866.5, 37, 864.74; 116/205, 116/209, DIG. 7; 33/1 H, 719, 624, 544–544.3
See application file for complete search history.

(56) References Cited

U.S. PATENT DOCUMENTS 1,994,884 A * 3/1935 Chew ..... 73/864.74 X
2,856,884 A * 10/1958 Savage ..... 116/2
3,611,794 A * 10/1971 Geeter ..... 175/50 X
3,714,811 A * 2/1973 Daigle et al. ..... 73/19.1
5,150,622 A * 9/1992 Vollweiler ..... 73/864.74
5,151,657 A * 9/1992 Tashjian ..... 324/326
6,018,909 A * 2/2000 Potts ..... 73/864.74 X
6,401,814 B1 * 6/2002 Owens et al. ..... 166/253.1
6,706,245 B2 * 3/2004 Neal et al. ..... 73/864.74 X
7,311,011 B2 * 12/2007 Clark et al. ..... 73/864.74

FOREIGN PATENT DOCUMENTS

GB 2335991 A * 10/1999
SU 1067135 A * 1/1984

OTHER PUBLICATIONS

JP 09310335 A, Dec. 1997, Japan, Hinohara et al., its Derwent Abstract.*

* cited by examiner

*Primary Examiner*—Thomas P Noland
(74) *Attorney, Agent, or Firm*—Conley Rose, P.C.

(57) ABSTRACT

Apparatus and methods for locating underground obstructions are disclosed. One embodiment of the present invention comprises an elongate probe with a first and second end and a first internal fluid passageway, a handle disposed on the elongate member, and a tip disposed on an end of the elongate member, wherein the tip comprises a second internal fluid passageway in fluid communication with the first internal passageway, and a flexible hose connection disposed on the elongate member, wherein the connection is disposed between the first end and the second end and the connection is in fluid communication with the first internal passageway.

33 Claims, 4 Drawing Sheets

LOCATING APPARATUS AND SYSTEM

CROSS-REFERENCE TO RELATED APPLICATIONS

This application claims priority to U.S. Provisional Application No. 60/624,002 filed Nov. 1, 2004 entitled "Locating Apparatus and System."

BACKGROUND INFORMATION

Before beginning construction or underground excavation, it is necessary to determine the location of underground obstructions that may be in the area of the intended construction or excavation. Various methods of locating such obstructions have been employed in the prior art. For example, electronic locaters may be employed that attempt to locate underground obstructions without actually penetrating the soil. However, these electronic locators are not always accurate, and a mechanical means of penetrating the soil and checking for obstructions is often desired. A common method in the prior art for locating underground obstructions is to force a rigid rod into the ground by hand to a desired depth. This requires substantial effort on the part of the operator, both in the insertion and removal of the rod, and can lead to injuries such as pulled muscles and back strains. An improved method of mechanically locating underground obstructions is therefore desired.

SUMMARY OF DISCLOSED EMBODIMENTS

Embodiments of the present invention comprise apparatus and methods used to locate underground obstructions prior to construction work being performed in an area. Embodiments of the present invention allow a rigid rod to be inserted into the ground and removed safely and with less effort than those of prior art apparatus and systems. In addition to other components, embodiments of the present invention comprise a locating rod, a fluid supply tank, a pump, connection hoses, and a template to provide a pattern for inserting the locating rod into the soil.

BRIEF DESCRIPTION OF THE DRAWINGS

For a more detailed description of the preferred embodiment of the present invention, reference will now be made to the accompanying drawings, wherein.

DETAILED DESCRIPTION OF DISCLOSED EMBODIMENTS

Figure 1:
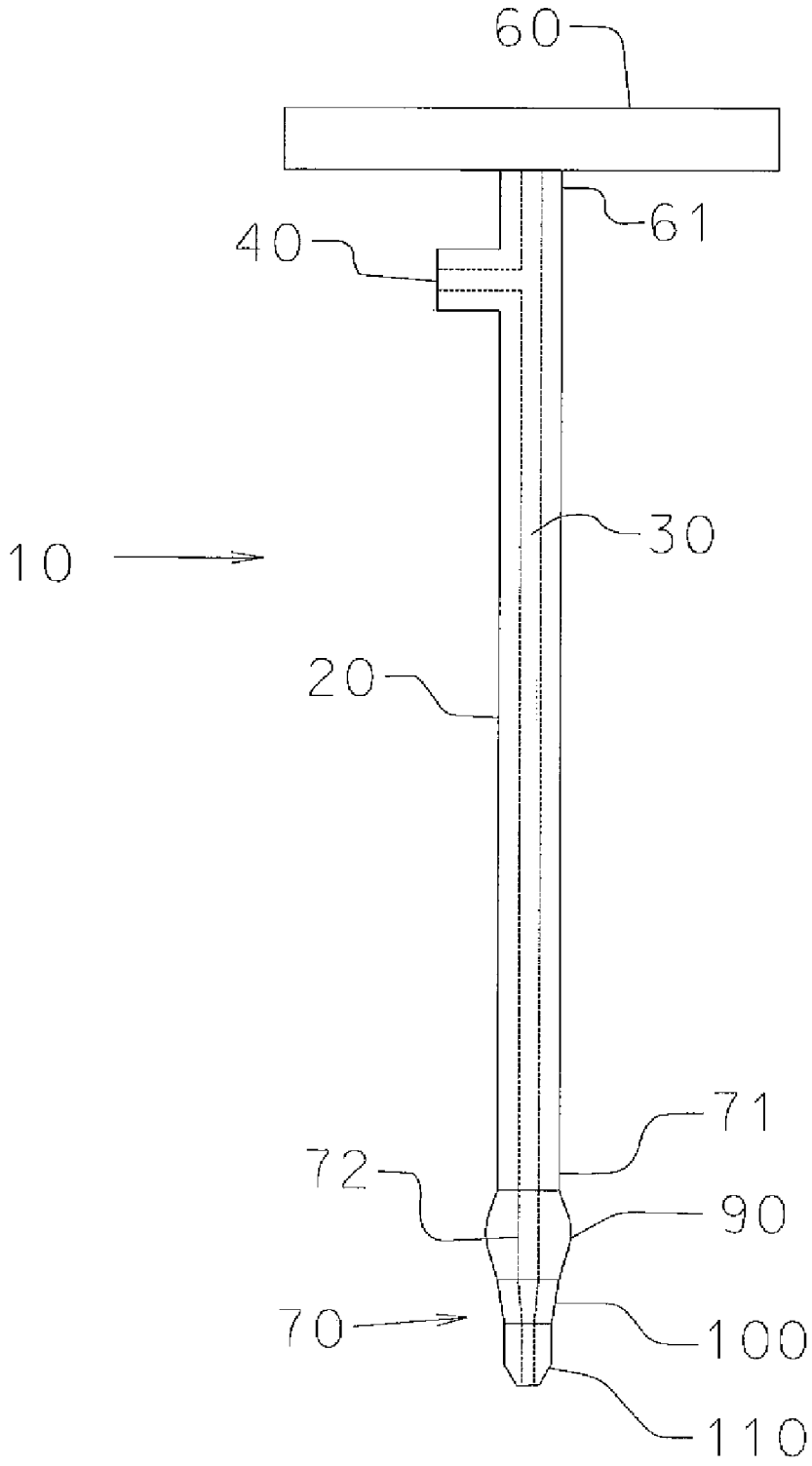
FIG. 1 is an elevational view of a locating rod.
Figure 2:
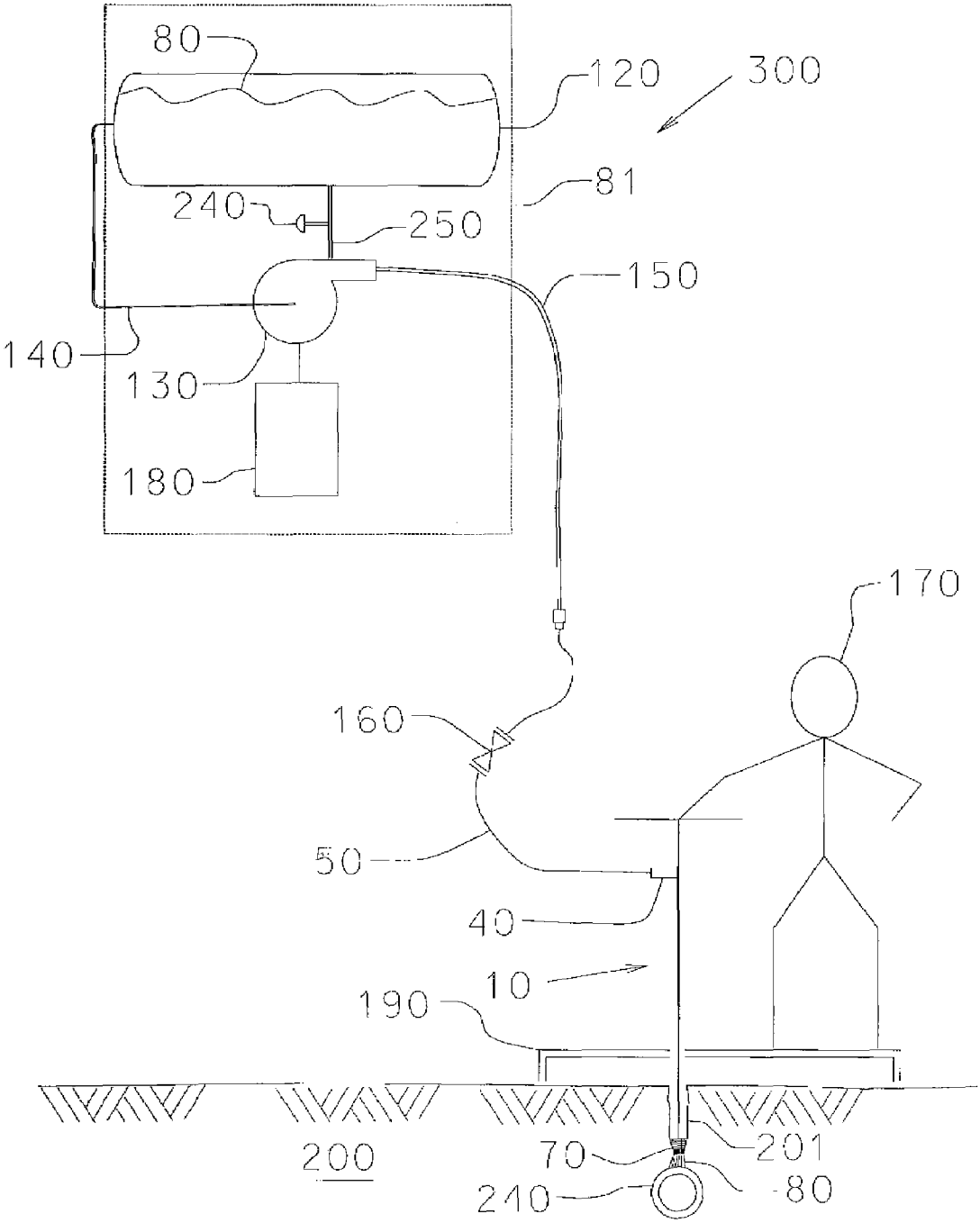
FIG. 2 is a schematic of a locating system.
Figure 3:
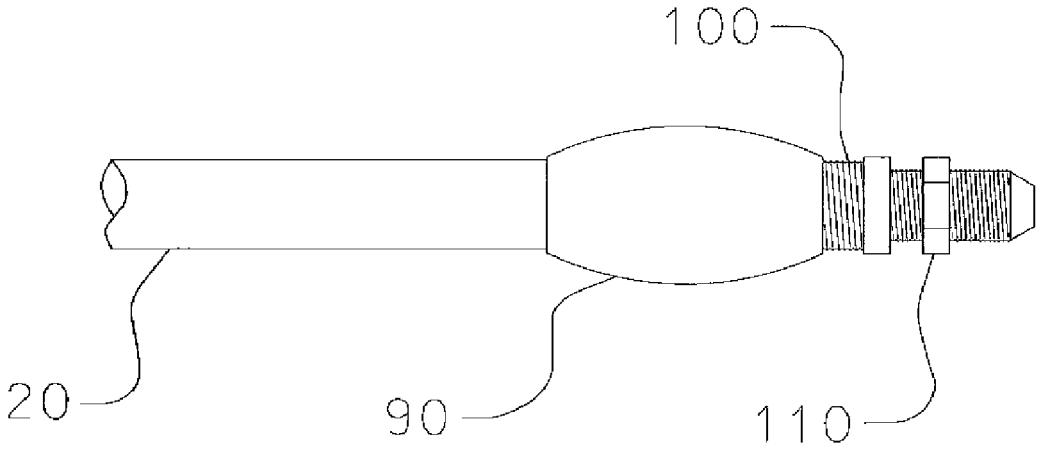
FIG. 3 is an elevational view of a tip on the locating rod.

As disclosed in FIGS. 1-3, embodiments of the present invention comprise an elongate locating rod or probe 10 comprising a rigid pipe or cylindrical member 20 with an internal fluid passageway 30 and a connection 40 for attaching a flexible connection hose 50. In one embodiment, rod 10 can be ¼" extra heavy seamless carbon steel pipe (with an outer diameter of approximately 0.54"). The embodiment in FIGS. 1 and 2 also comprises a stainless steel "T" handle 60 located at end 61 of cylindrical member 20. Cylindrical member 20 can be various lengths, but lengths of 4 to 12 feet are preferred. A tip 70 with internal fluid passageway 72 disposed on end 71 of locating rod 10 increases the velocity of a fluid 80 exiting locating rod 10. In the embodiment shown in FIG. 3, tip 70 comprises a ⅝" coupler 90 (modified so that each end is tapered on the outer diameter) which threads onto end 71 of cylindrical member 20. In one embodiment, coupler 90 is formed from a standard coupler with a cylindrical outer surface and an outer diameter that is constant throughout the length of the coupler. Coupler 90 is formed by grinding or otherwise machining the ends to produce the tapered shape shown in FIG. 3. As shown more clearly in the embodiment of FIG. 3, a ¼" to ⅛" pipe bushing 100 is threaded into coupler 90, and a brass ¼" flare fitting 110 is threaded into pipe bushing 100.

As shown in the embodiment in FIG. 2, locating rod 10 is connected to a pump 130 via a flexible connection hose 50 and a flexible supply hose 150. Pump 130 is connected to fluid supply tank 120 via pipe or line 140. In addition, a valve 160 is located on connection hose 50 in close proximity to locating rod 10, so that an operator 170 may operate valve 160 while holding locating rod 10. With valve 160 open, fluid 80 (not shown) from fluid supply tank 120 can flow through pipe 140, pump 130, supply hose 150, connection hose 50, into locating rod 10 an be emitted from tip 70. If valve 160 is in the closed position, fluid will be prevented from entering locating rod 10.

Fluid supply tank 120 can be of various sizes, but larger sizes, such as 525 gallons, will reduce the need to refill fluid supply tank 120 as often. Pump 130 can be a positive displacement pump, such as a piston pump, that delivers relatively high pressure (i.e. approximately 200 psi or greater) at relatively low flow (i.e. approximately 5 gallons per minute). In the embodiment shown in FIG. 2, an internal combustion engine 180 provides power to pump 180. In other embodiments, other power devices, such as an electric motor (not shown) may be used to power pump 130. In one embodiment, engine 180 is a 6½ horsepower engine, but other power output levels can be utilized in different embodiments. In the embodiment shown in FIG. 2, supply hose 150 is a ½" diameter hose approximately 300' long. Supply hose 150 can also be stored on a reel (not shown). In some embodiments, supply tank 120, pump 130, engine 180 and supply hose 150 may be mounted on a wheeled base 81, such as a trailer or a motorized vehicle (shown schematically in FIG. 2) to provide for easy transport of the equipment to remote locations and to make the entire system 300 self-contained and portable. Supply hose 150 connects to one end of connection hose 50, which in one embodiment is a ⅜" diameter hose that is approximately fifteen feet long. The other end of connection hose 150 connects to connection 40 on locating rod 10. In one embodiment, valve 160 on flexible hose 150 is a ¼ turn ball valve that can be quickly opened and closed by operator 170.

Figure 4:
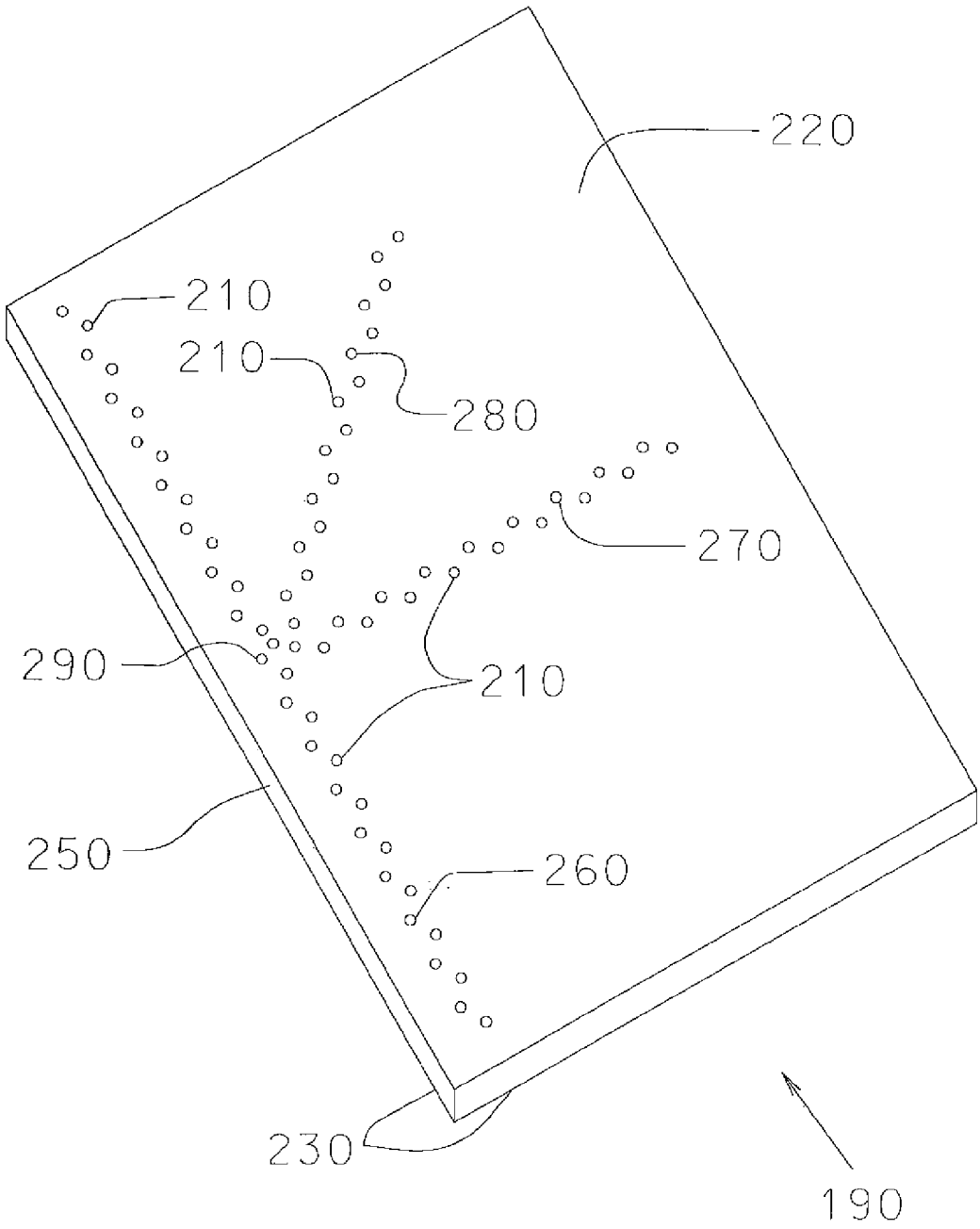
FIG. 4 is a perspective view of a template.

In addition, a template 190 can be utilized to provide a positive location for locating rod 10. Template 190 can also serve as a barrier between the soil 200 and operator 170. A top perspective view of template 190 is provided in FIG. 4. Template 190 can include a plurality of holes 210 of various spacing, but 2" spacing is used in one embodiment. Holes 210 can be 11/16" diameter to allow cylindrical member 20 and tip 70 to pass through holes 210. Template 190 can be constructed of various components and thicknesses, but in one embodiment is constructed of a sheet of ¾" thick plywood 220 supported by 1"×4" lumber 230 mounted underneath plywood 220 so that the wider portion 250 of lumber 230 is perpendicular to the surface of plywood 220.

A method of utilizing the previously-described equipment to locate underground obstructions is given below. In one embodiment, fluid supply tank 120 and pump 130 are placed in the general proximity of an area in which an underground obstruction 240 is to be located. As previously mentioned, fluid supply tank 120 and pump 130 may be transported on a trailer or motorized vehicle. The inlet or suction of pump 130 is connected to fluid supply tank 130 and the outlet or discharge of pump 130 is connected to one end of flexible supply hose 150. The other end of supply hose 150 is connected to connection hose 50 with shutoff valve 160. Connection hose 50 is then connected to locating rod 10 via connection 40. As shown in FIG. 1, locating rod 10 includes cylindrical member 20 with internal fluid passageway 130 for conducting water or other fluid therethrough. Operator 170 places template 190 over the area to be surveyed or "located" (i.e. checked for underground obstructions). With valve 160 on flexible hose 50 in the closed position, power is provided to pump 130 by starting engine 180. As shown in FIG. 2, a pressure regulator 240 (or a minimum flow valve, not shown) and a recirculation line 250 allow pump 130 to operate with valve 160 in the closed position.

Operator 170 holds handle 60 of locating rod 10, placing locating rod 10 in a vertical orientation. Operator 170 places tip 70 of locating rod 10 in the first hole 210 of template 190 corresponding to the first location that is to be checked for underground obstructions. With tip 70 placed in hole 210, valve 160 can then be moved to the open position. In one embodiment, valve 160 is close enough to handle 60 of locating rod 10 so that a single operator 170 can hold handle 60 of locating rod 10 and operate valve 160.

With tip 70 of locating rod 10 inserted into template 190 and handle 160 in the open position with the pump 130 running, fluid 80 will exit tip 70 of locating rod 10. Various fluid pressures may be used depending on the soil condition, but 100-200 psi is typical. Fluid 80 exiting tip 70 of locating rod 10 allows operator 170 to insert locating rod 10 into soil 200 without excessive effort. If the top layer of soil is too hard to penetrate with locating rod 10, a backhoe (not shown) may be employed to remove the upper layer. If a backhoe is not available, a solid metal rod (not shown) can be lightly hammered into the soil to penetrate the upper crust. Once the upper layer has been penetrated, locating rod 10 can be inserted into hole 210 and pushed into soil 200.

As shown in the embodiment of FIG. 3, tip 70 of locating rod 10 is comprised of a threaded coupler 90 with an outside diameter of approximately ⅝" that is slightly larger than the outer diameter of the cylindrical member 20. Coupler 90 may be tapered on each end to provide easier insertion and removal of locating rod 10 into soil 200, as further described below. In addition, tip 70 has bushing 100 connected to an outlet such as a ¼" flare fitting 110 that provides for increased velocity of fluid 80 exiting locating rod 10.

As best shown in FIG. 2, operator 170 inserts locating rod 10 into soil 200, fluid 80 exiting tip 70 of locating rod 10 clears a path 201 through soil 200 for locating rod 10 to be inserted into soil 200. Because the diameter of tip 70 is slightly larger than cylindrical member 20, path 210 will be slightly larger than the diameter of cylindrical member 20. This will also reduce friction between soil 200 and cylindrical member 20 and will allow easier insertion and removal into soil 200. In addition, fluid 80 provides feedback to operator 170 when tip 70 of locating rod 10 becomes close to obstruction 240.

In prior art methods and apparatus that employed a rigid rod without a fluid stream being conveyed through the rod, the operator had no advance warning when the end of the rod was nearing an obstruction. Using such a prior art device, the operator could accidentally damage an obstruction, such as a phone or cable line, because there was no advance indication that the end of the rod was nearing an obstruction. In embodiments of the present invention, fluid 80 contacts obstruction 240 before tip 70 of locating rod 10 makes contact with obstruction 240. When tip 70 is in close proximity to obstruction 240, back pressure from fluid 80 provides some feedback to operator 170 to let him or her know that obstruction 240 is being approached and reduces the likelihood of damaging obstruction 240 by contacting it with locating rod 10. If obstruction 240 is found to be in a construction area, obstruction 240 or the construction area can be relocated to prevent damage to obstruction 240. In addition, the end of tip 70 is preferably constructed of brass or a similar material that is not as hard as some underground obstructions, such as rigid pipes, to reduce the likelihood of damaging underground obstruction 240 if contact is made with locating rod 10.

Template 190 provides numerous benefits in embodiments of the present invention. For example, template 190 reduces the likelihood of fluid 80, mud or soil 200, from splashing on operator 170. Operator 170 should not open valve 160 (which allows fluid 80 to enter locating rod 10) until tip 70 of locating rod 10 has been placed through template 190. Because hole 210 is only slightly larger than the diameter of they cylindrical member 20, the likelihood of mud or fluid 80 splashing on operator 170 is reduced. Valve 160 can then be closed after hole 210 has been probed and before locating rod 210 is removed from template 190. After locating rod 10 has been inserted in the next hole 210 in template 190, valve 160 can then be re-opened to allow fluid pressure to be applied to locating rod 210 and the next hole 210 can be probed. This procedure is repeated until the desired number of holes 210 have been probed.

Template 190 also helps to ensure that locating rod 10 is inserted in a vertical manner by serving as a guide to help operator 170 insert locating rod 10 into soil 200. Inserting locating rod 10 vertically helps to ensure that soil 200 is accurately probed. Although the depth to which locating rod 10 is inserted into soil 200 will vary according to the specifications of each job performed, a depth of approximately 9-10 feet is common. Therefore, if locating rod 10 is inserted at an angle instead of vertical, tip 70 of locating rod 10 will not be in the desired location after locating rod 10 has been inserted.

Template 190 also serves to ensure the accuracy of the horizontal spacing of the probe hole locations. This spacing will typically be determined by customer requirements for a particular job. In one embodiment best shown in FIG. 4, template 190 comprises holes 210 arranged in two rows 260 and 270 oriented perpendicular to each other, and a third row 280 oriented at an angle θ from row 270. In one embodiment θ is approximately 45 degrees. Template 190 is placed such that the intersection 290 of rows 260, 270 and 280 is generally at the center of the area of soil 200 to be probed, and the desired number of holes 210 in template 190 are then probed. After a sufficient perimeter around the construction area has been probed (based on customer specifications, but typically two feet around the circumference of the construction area), template 190 can be rotated 180 degrees around intersection 290. The desired number of holes 210 can again be probed with template 190 in the new position.

If desired, multiple locating rods can utilized with a single water source and pump. For example, supply hose 150 may be connected to a tee fitting that allows two connection hoses 50 to be connected to the fitting. The connection hoses 50 can then each be connected to separate locating rods 10. In addition, multiple sections of threaded pipe can be connected to make longer locating rods, including embodiments in which the locating rod is 40 feet long. In a method using multiple sections, a section comprising handle 60 and connection 40 is connected to another section of threaded pipe comprising tip 70. The section of pipe comprising tip 70 is inserted into the ground using the manner described above until the section is almost fully inserted. The fluid pressure is then shut off by closing valve 160 (or turning off pump 130) and the section comprising handle 60 and connection 40 is disconnected from the section comprising tip 70. A new section of pipe is then connected to the section comprising tip 70 and the section comprising handle 60 and connection 50. The section comprising tip 70 and the new section are then further inserted into the ground. If desired, a additional new sections can be added and further inserted in a manner similar to that used to add the first new section. The process is repeated until the desired depth has been reached. In one embodiment, the sections of threaded pipe are connected with couplers similar to coupler 90 where the outer diameter is tapered on each end. This configuration substantially decreases the force needed to insert and remove locating rod 10.

Embodiments of the present invention incorporate certain advantages over solid rod probing devices of the prior art. For example, operator 170 does not have to exert as much effort to insert or remove the locating rod 10 into soil 200 as compared to prior art rods that did not have a tip that emitted fluid. In certain embodiments, tip 70 creates a path 201 in soil 200 that is larger than the outer diameter of cylindrical member 20. This allows fluid 80 to fill the gap between cylindrical member 20 and soil 200 and makes removal of locating rod 10 easier as compared to prior art rods. Embodiments of the present invention also allow an operator to perform a locating job more quickly and with less effort and injuries as compared to certain prior art methods. Also, fewer operators are needed to perform locating jobs than conventional methods because the level of effort expended is lower as compared to the prior art.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims. Unless otherwise noted, sequential recitation of steps in the claims is not intended to require that the steps be performed sequentially, or that one step be completed before commencement of another step.

What is claimed is:

1. An apparatus for locating underground obstructions comprising:

an elongate member with a first and second end and a first internal fluid passageway;

a tip disposed on an end of said elongate member, and having a second internal fluid passageway in fluid communication with said first internal passageway, said tip configured to accelerate fluid passing therethrough; and a connection port disposed on said elongate member, wherein said connection port is disposed between said first end and said second end, and said connection port is in fluid communication with said first internal passageway.

2. The apparatus of claim 1 wherein said elongate member is comprised of multiple sections.

3. The apparatus of claim 2 wherein said multiple sections are threadably connected.

4. The apparatus of claim 1 wherein said tip comprises an outer diameter that is larger than the outer diameter of said elongate member.

5. The apparatus of claim 1 wherein said elongate member is at least four feet long.

6. The apparatus of claim 1 wherein said tip comprises an end portion that is made of brass.

7. The apparatus of claim 1 wherein said tip is threaded onto said second end of said elongate member.

8. The apparatus of claim 1 wherein said tip is comprised of a coupler, a bushing, and a flare fitting.

9. The apparatus of claim S wherein said coupler has an outer surface that is tapered at each end.

10. The apparatus of claim 1 wherein said elongate member has an outer diameter less than one inch.

11. The apparatus of claim 1 wherein said elongate member comprises a connector having a pair of ends and a center portion wherein the outer diameter of said ends is less than the outer diameter of said center portion.

12. A system for locating underground obstructions comprising:

a probe comprising:

an elongate member with a first and second end and a first internal fluid passageway;

a tip disposed on said second end of said elongate member; and having a second internal fluid passageway in fluid communication with said first internal passageway, said tip configured to accelerate fluid passing therethrough; and a connection port disposed on the elongate member, wherein the connection port is disposed between the first end and the second end, and the connection port is in fluid conununication with the first internal passageway;

a fluid supply; and a pump in fluid communication with said fluid supply and said first internal passageway in said elongate member.

13. The system of claim 12, wherein said probe further comprises a handle disposed on the elongate member.

14. The system of claim 13, wherein said handle comprises a member disposed generally perpendicular to said elongate member,

15. The system of claim 12, wherein said tip comprises an outer diameter that is larger than the outer diameter of said elongate member.

16. The system of claim 12, wherein said elongate member is at least four feet long.

17. The system of claim 12, wherein said tip comprises an end portion that is made of brass.

18. The system of claim 12, wherein said tip is threaded onto said second end of said elongate member.

19. The system of claim 12, wherein said tip is comprised of a coupler, a bushing, and a flare fitting.

20. The system of claim 19, wherein said coupler has an outer surface that is tapered at each end.

21. The system of claim 12, further comprising a hose interconnecting said pump and said connection port.

22. The system of claim 21, wherein said hose is a flexible hose.

23. The system of claim 12, further comprising a valve disposed between said connection port and said pump, said valve controlling flow of fluid to said elongate member.

24. The system of claim 12, further comprising a template having a plurality of holes, wherein said holes are large enough to allow said elongate member and said tip to pass through said holes.

25. The system of claim 24, wherein said plurality of holes are arranged in an array having a first row.

26. The system of claim 24, wherein said plurality of holes are arranged in an array having a first row and a second row perpendicular to said first row.

27. The system of claim 24, wherein said plurality of holes are arranged in an array having a first row, a second row perpendicular to said first row and a third row at an acute angle with respect to said first row and said second row.

28. The system of claim 12, further comprising an engine for driving said pump, wherein said pump, fluid source, and engine are located on a wheeled platform.

29. A method of locating underground obstructions comprising:

providing a fluid source and a pump wherein said fluid source and said pump are in fluid communication;

providing a probe in fluid communication with said pump, said probe comprising;

a first elongate member with a first and second end and a first internal fluid passageway;

a tip disposed on the second end of the elongate member and having a second internal fluid passageway in fluid communication with the first internal passageway. said tip configured to accelerate fluid passing therethrough; and a connection port disposed on the first elongate member, wherein the connection port is disposed between the first end and the second end, and the connection port is in fluid communication with the first internal passageway;

wherein the connection port is fluidicly coupled to said pump to allow a fluid from said fluid source to be emitted from the tip of said probe;

providing a template having a plurality of holes in a predetermined pattern;

placing said template over an area of soil;

inserting the tip of said probe into a first hole in said template;

operating said pump and increasing the pressure of said fluid;

emitting a fluid from the tip of said probe;

inserting said probe into said soil to a predetermined depth.

30. The method of claim 29, wherein said predetermined pattern comprises a first row, a second row perpendicular to said first row, and a third row that is at an acute angle with respect to said first row and said second row, and;

said probe is inserted into a plurality of holes in said first row and into said soil;

said probe is inserted into a plurality of holes in said second row and into said soil;

said probe is inserted into a plurality of holes in said third row and into said soil;

said template is rotated;

said probe is inserted into a plurality of holes in said first row and into said soil;

said probe is inserted into a plurality of holes in said second row and into said soil;

said probe is inserted into a plurality of holes in said third row and into said soil.

31. The method of claim 29, further comprising;

providing a valve between said fluid source and said probe;

ensuring that said valve is in the closed position before inserting the tip of said probe into a first hole in said template; and opening said valve.

32. The method of claim 31, further comprising;

removing said probe from said first hole in said template;

inserting said probe into a second hole in said template;

opening said valve;

emitting said fluid from said probe;

inserting said probe into said soil to a predetermined depth;

removing said probe from said soil and closing said valve; and removing said probe from said second hole in the template.

33. The method of claim 31, further comprising;

stopping a flow of said fluid to said probe;

connecting a second elongate member to the first elongate member of said probe;

establishing a flow of said fluid to the first and the second elongate members of said probe; and inserting the first and the second elongate members of said probe into said soil to a second predetermined depth.

* * * * *